US005649527A

United States Patent [19]

Olsen et al.

[11] Patent Number: 5,649,527

[45] Date of Patent: Jul. 22, 1997

[54] ARCHERY BOW STABILIZER AND STRING TRACKER MOUNTING MEANS

[75] Inventors: Arthur V. Olsen, Chelmsford, Mass.; Dennis James Heath, Wells River, Vt.

[73] Assignee: Jon P. Doherty, N. Billerica, Mass.

[21] Appl. No.: 465,542

[22] Filed: Jun. 5, 1995

[51] Int. Cl.[6] ..... F41B 5/20; F41B 5/14

[52] U.S. Cl. ..... 124/89; 124/86

[58] Field of Search ..... 124/23.1, 86, 88, 124/89

[56] References Cited

U.S. PATENT DOCUMENTS

| | | | |
|---|---|---|---|
| 3,377,999 | 4/1968 | Reynolds | 124/88 |
| 3,752,142 | 8/1973 | Morita et al. | 124/89 |
| 3,840,944 | 10/1974 | Gresley | 124/88 X |
| 4,054,121 | 10/1977 | Hoyt | 124/89 |
| 4,553,522 | 11/1985 | Topping | 124/89 |
| 4,726,348 | 2/1988 | Saunders | 124/23.1 |
| 4,788,961 | 12/1988 | Toth | 124/88 X |
| 4,955,356 | 9/1990 | Pike et al. | 124/89 |
| 4,957,095 | 9/1990 | Cameron | 124/89 |
| 5,038,510 | 8/1991 | Duke | 43/4 |
| 5,123,396 | 6/1992 | Shepley et al. | 124/88 X |
| 5,143,044 | 9/1992 | Bourquin | 124/88 |
| 5,239,977 | 8/1993 | Thomas | 124/89 |

*Primary Examiner*—John A. Ricci

*Attorney, Agent, or Firm*—Scott B. Garrison; Gary E. Lambert

[57] ABSTRACT

A combination archery bow stabilizer and string tracker mounting adaptor having a telescopic capability to raise or lower the string tracker. Used in conjunction with a 360 degree rotatable arm to which the string tracker is mounted, minimization of the noise created by slack string tightening upon launching an arrow is possible. The adaptor and rotable arm are capable of adjustment for the needs of the individual archer or archery bow to which it is mounted.

7 Claims, 3 Drawing Sheets

ARCHERY BOW STABILIZER AND STRING TRACKER MOUNTING MEANS

BACKGROUND OF THE INVENTION

The present invention relates to archery bow stabilizers and string trackers. More particularly, it pertains to an adaptor which permits the combination of a stabilizer and other archery accessories, such as a string tracker, which is capable of adjustment for the needs of the individual archer or archery bow to which it is mounted. Archery bow stabilizers and string trackers in their individual capacities are numerous throughout the prior art. However combinations of archery bow stabilizers and string trackers are not as common, yet they are known as well. One example of such a combination is Pike et al., U.S. Pat. No. 4,995,356.

Additionally, the prior art discloses various forms of mounting means for stabilizers or string trackers. Topping, U.S. Pat. No. 4,553,522 discloses a unitary mounting structure for the resilient and universally adjustable mounting of a pair of stabilizer rods. Hoyt, Jr., U.S. Pat. No. 4,054,121 discloses a mounting means capable of permitting a pair of stabilizers to be angularly adjusted in both the horizontal and vertical planes and subsequently locked into the desired position.

One of the concerns with prior art string trackers is that they are not mounted in an optimal position relative to the arrow. The resulting problem is that a loop of string typically hangs between the tracker spool and the arrow head; the two points where the string is attached. This loop is easily snagged on brush in the field. Saunders, U.S. Pat. No. 4,726,348, attempts to remedy this problem by the use of a clip attached to the archery bow which is structured such that it holds the hitherto slack string.

While the above mentioned devices are directed to mounting apparatuses and combination stabilizer and string trackers none eliminate an important problem the archer faces when using a string tracker, that is, the noise created by the slack string suddenly becoming taut as the arrow is launched through the air.

SUMMARY OF THE INVENTION

The present invention relates to an archery bow stabilizer and string tracker mounting apparatus capable of mounting off the shelf stabilizer elements and off the shelf string tracker devices onto a single unit which is then attached to a stabilizer mounting hole integral to the bow itself. The mounting apparatus is capable of telescopic extension thus permitting optimal vertical positioning of the string tracker device. Once the optimal vertical position is set the string tracker device is further permitted rotational positioning to minimize the distance; and increase alignment; between the tracker spool and the arrow head. The result of this minimization in distance and increase in alignment is one of the primary objects of this invention, to reduce the amount of noise generated by the rapid tightening of the string upon launching the arrow.

Another object of the present invention is to provide a single unit capable of mounting both stabilizer elements and string tracker devices.

Still another object of the present invention is to provide the capability to remove the string tracker and substitute an additional stabilizer element in its place.

Another object of the present invention is to increase the yardage of string which pays out of the tracker spool as a result of the drag on the string by positioning the string tracker device and the arrow head closer together.

Yet another object of the present invention is to provide a lightweight, compact, portable and easily installed mounting means for stabilizer elements and string tracker devices capable of individual adjustment in the field.

BRIEF DESCRIPTION OF THE DRAWINGS

Additional objects and features of this invention and the manner of attaining them will become apparent, and the invention itself will be best understood by reference to the following description of the embodiment of the invention in conjunction with the accompanying drawings wherein.

DETAILED DESCRIPTION OF THE PREFERRED EMBODIMENT

Figure 1:
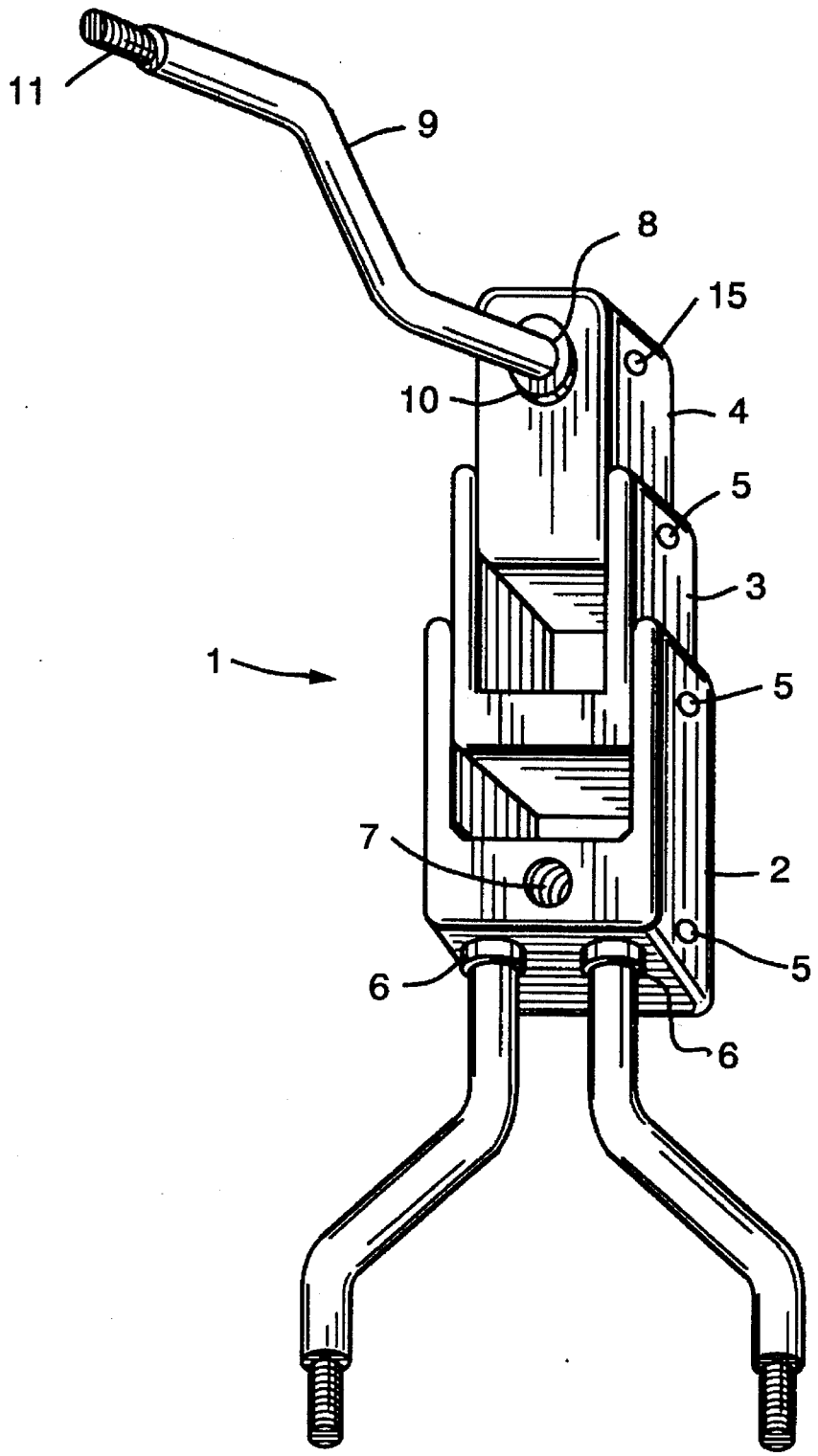
FIG. 1 is an oblique view from the forward and right edge of the adaptor in its fully telescoped position, showing the stabilizer holes and offset string tracker mounting arm.

Referring to the drawings in greater detail, specifically FIG. 1, an adaptor generally indicated at I; comprises a lower element 2, an intermediate element 3, and an upper element 4. The upper element 4 telescopically slides within the intermediate element 3 which itself telescopically slides within the lower element 2. Telescopic extension and retraction is accomplished by manually pulling or pushing the upper and intermediate elements into the lower element. Once the desired position is set, an allen screw 5 is tightened which locks the assembly into the position it is set. The lower element 2 is provided with three stabilizer element mounting holes 6, arranged to accept two stabilizer elements on the bottom face and one on the lower forward face of lower element 2. The two stabilizer element mounting holes on the bottom face are spaced equidistant from the centerline of the lower element in the front to back direction, and along the same axis in the left to right direction. The stabilizer element mounting hole on the lower forward face is centered in the top to bottom direction of the lower element.

Figure 2:
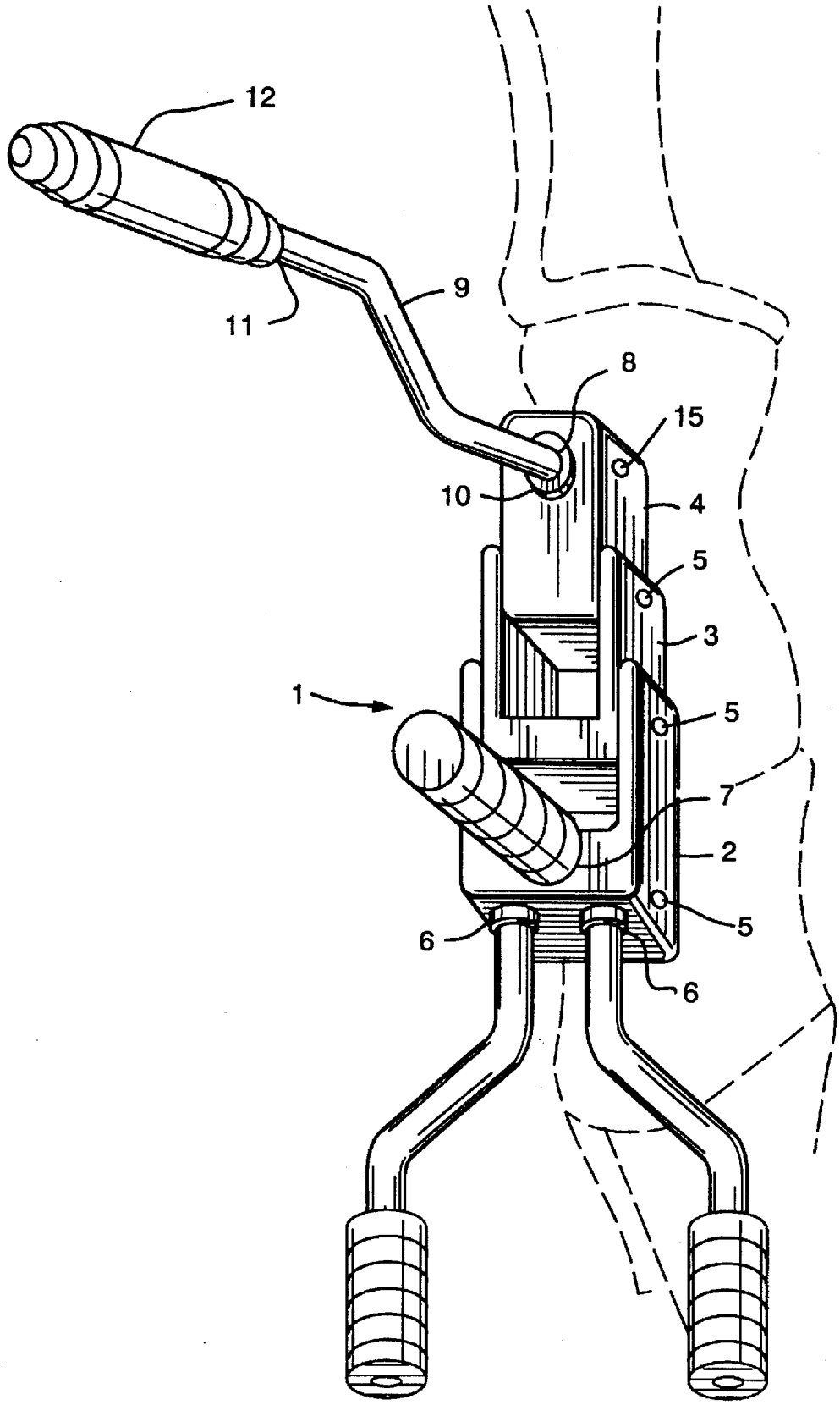
FIG. 2 is a perspective view of the invention showing the adaptor mounted to an archery bow and the use of three stabilizer elements and a string tracker mounted on the offset mounting arm.
Figure 3:
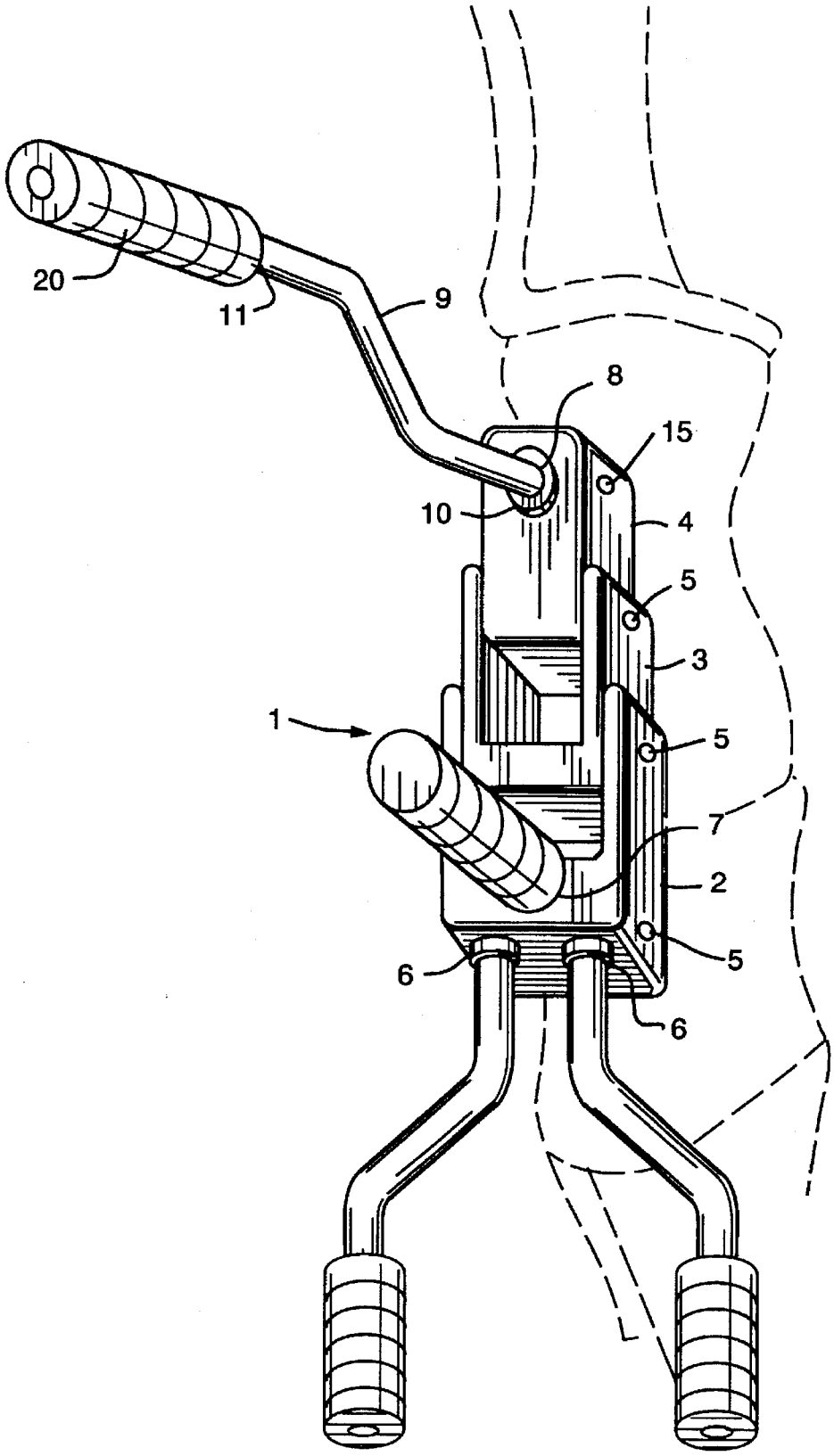
FIG. 3 is a perspective view similar to FIG. 2 depicting an additional stabilizer element on the offset mounting arm in place of a string tracker.

Lower element 2 is also provided with a threaded connection 7 located on the back face of lower element 2 which is used to mount adaptor 1 to an archery bow at the archery bows existing stabilizer hole. Upper element 4 is provided with a string tracker mounting hole 8 in which an offset mounting arm 9 is attached. The offset mounting arm 9 has two threaded ends, wherein first end 10 is capable of mounting into string tracker mounting hole 8 and second end 11 is capable of receivably mounting a string tracker 12 as depicted in FIG. 2 or alternatively an additional stabilizer element 20 as depicted in FIG. 3. The offset mounting arm 9 is capable of 360 degree rotation and locking into that position at first end 10, as depicted in FIG. 3 by locking mechanism 15. A fastening device such as an additional allen screw would be sufficient to accomplish this feature.

The invention minimizes the noise created by the slack string between the arrow head and the tracker spool suddenly becoming taut as the arrow is launched through the air. This is accomplished by adjusting both the telescopic placement of the adaptor and the rotational positioning of the offset mounting arm, so that the distance between the arrow head and the tracker spool of the string tracker is minimized and their alignment to each other is maximized. Proper positioning of the adaptor and the offset mounting arm minimizes the amount of slack line thereby reducing the line noise, increasing the distance of the arrow's flight, and increasing the archer's consistency.

What is claimed is:

1. An archery bow stabilizer and archery accessory mounting device comprising: a lower element, an upper element, at least one intermediate element, said lower element including attachment means for stabilizer elements and means for attaching said lower element to an archery bow, said upper element including attachment means capable of receiving archery attachments, said lower, intermediate, and upper elements capable of telescopic extension and retraction within each other to increase or reduce the distance from a lowermost face of said lower element to an uppermost face of said upper element.

2. A device according to claim 1 wherein the distance between the said lower element and said upper element, once set can be locked into place by a locking means.

3. A device according to claim 2 in combination with a string tracker wherein said string tracker is attached to said upper element attachment means, said string tracker is capable of vertical adjustment in the plane defined by the length of said archery bow by telescopic movement of said upper and intermediate elements within said lower element.

4. A device according to claim 2 in combination with a stabilizer element wherein said stabilizer element is attached to said upper element attachment means, said stabilizer element is capable of vertical adjustment in the plane defined by the length of said archery bow by telescopic movement of said upper and intermediate elements within said lower element.

5. A device according to claim 2 in combination with a string tracker wherein a mounting arm having a first and second end, is attached by said first end to said upper element attachment means and said string tracker is attached to said second end of said mounting arm, said string tracker is capable of vertical adjustment in the plane defined by the length of said archery bow by telescopic movement of said upper and intermediate elements within said lower element.

6. A device according to claim 5 wherein said first and second ends of said mounting arm are offset from each other but maintain a parallel planar relationship with respect to each other, said parallel planar relationship allowing for the 360 degree rotation of said second end of said mounting arm with respect to said first end of said mounting arm.

7. A device according to claim 6 wherein said rotational position of said second end of said mounting arm is capable of being locked into the desired position by means of a locking device.

* * * * *